United States Patent [19]

Mikulecky

[11] 4,090,164

[45] May 16, 1978

[54] FUSE HAVING A THREADED SUPPORT STRUCTURE

[75] Inventor: Harvey W. Mikulecky, Oconomowoc, Wis.

[73] Assignee: RTE Corporation, Waukesha, Wis.

[21] Appl. No.: 795,201

[22] Filed: May 9, 1977

[51] Int. Cl.[2] ..... H01H 85/04

[52] U.S. Cl. ..... 337/159; 337/231

[58] Field of Search ..... 337/231, 208, 237, 238, 337/161, 248, 158, 159

[56] References Cited

U.S. PATENT DOCUMENTS

| | | | |
|---|---|---|---|
| 3,213,242 | 10/1965 | Cameron | 337/158 X |
| 4,001,748 | 1/1977 | Salzer | 337/159 |
| 4,034,328 | 7/1977 | Salzer | 337/159 |

*Primary Examiner*—George Harris

*Attorney, Agent, or Firm*—Ronald E. Barry

[57] ABSTRACT

A high voltage fuse of the current limiting type including a housing of insulating material, a cylindrical support formed by an inorganic asbestos thread or string threaded on end plates which are mounted in a spaced relation on a support rod, the thread forming a cylindrical support for a fusible element which is spirally wrapped about the cylindrical support. An arc quenching material is used to fill the housing and completely surround said fusible element.

14 Claims, 4 Drawing Figures

FUSE HAVING A THREADED SUPPORT STRUCTURE

BACKGROUND OF THE INVENTION

Generally, current limiting fuses include an insulating spider within an insulating housing to support the fusible element. The spider is formed of a high temperature inorganic material with ribbed members provided at spaced intervals for supporting the fusible element. In some instances the spider may be formed of a gas evolving material. With this type of a design, the fusible element does not have a cylindrical shape since it is supported by a number of straight sections which produce a bend at the end of each ribbed area. It has also been found that the ionized gas produced on vaporization of the element follows the flat surface of the supporting ribs of the spider sometimes causing flashover and possible fuse failure.

In high voltage fuses, self-supporting fusible elements have been provided within the arc quenching material in order to eliminate the problem of the ionized gases flowing along the flat rib sections. However, in these fuses it was difficult to maintain the fusible element in the proper position in the fuse housing resulting in other flashover problems.

SUMMARY OF THE INVENTION

The high voltage current limiting fuse of the present invention provides a fuse assembly having a fuse element mounted in a substantially cylindrical configuration. The cylindrical support for the fuse element is provided by a thread or string which is wrapped around a pair of spaced discs mounted on a threaded support rod. The cylindrical form of the fuse element reduces the physical size of the fuse resulting in greater efficiency of materials. The string also provides a minimum area of support which is exposed to the fuse element and thus minimizes the possibility of ionized gases following the support member.

DRAWINGS

DESCRIPTION OF THE INVENTION

Figure 1:
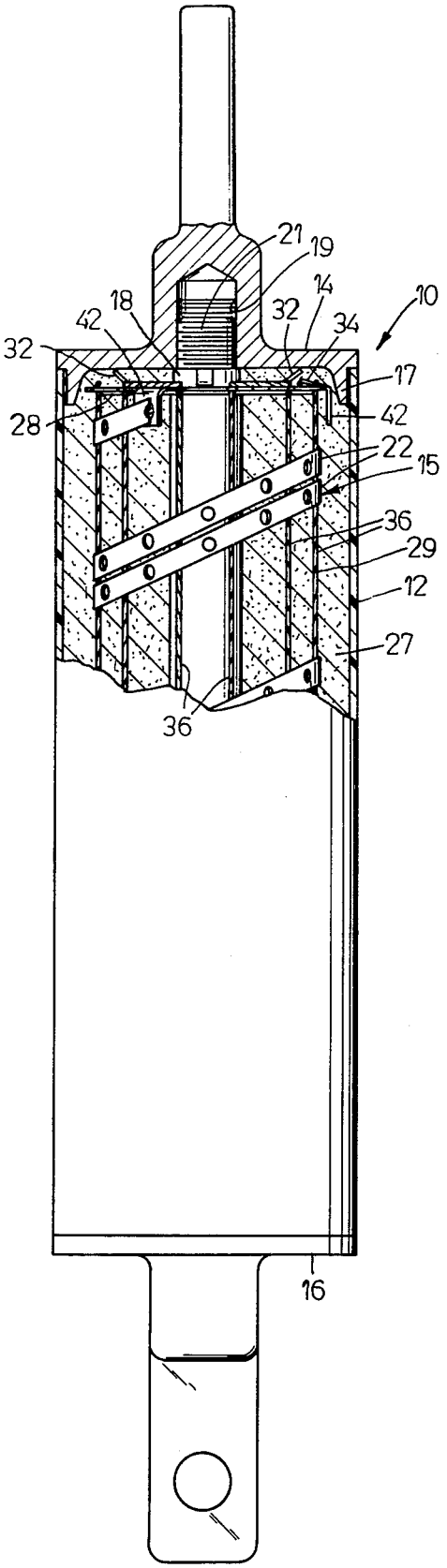
FIG. 1 is a view in elevation of the fuse with a portion of the housing broken away to show the fuse assembly.
Figure 3:
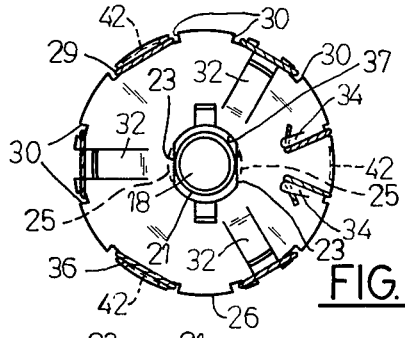
FIG. 3 is an end view of the fuse assembly.
Figure 2:
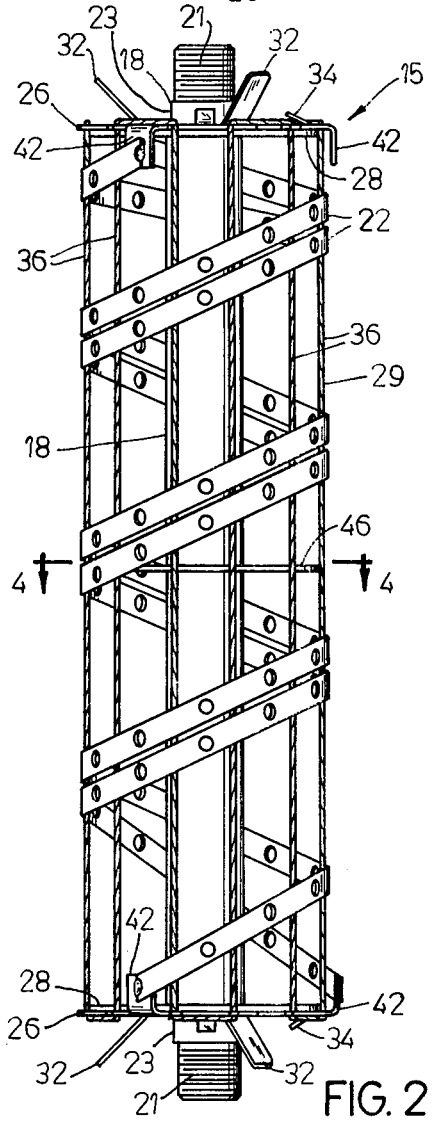
FIG. 2 is an elevation view of the fuse assembly.
Figure 4:
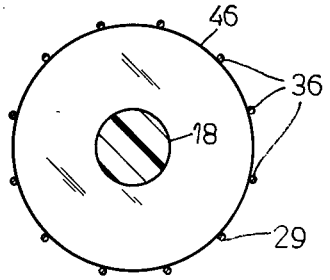
FIG. 4 is a view taken on line 4—4 of FIG. 3 showing the cylindrical arrangement of the thread.

Referring to the drawings, the high voltage current limiting fuse 10 generally includes a housing 12 having a fuse assembly 15 supported therein by means of electrically conductive end caps 14 and 16. The housing 12 is filled with an arc quenching granular material 27.

The housing 12 is shown in the form of a hollow tube that is made of a dielectric material. The electrically conductive end caps 14 and 16 are provided with means in the form of a peripheral flange 17 to provide a seal with the inner surface of the housing 12. A centrally located threaded hole 19 is provided in the inside end of each of the end caps 14 and 16.

In accordance with the invention, the fuse assembly 15 includes means for supporting a fuse element 22 in a generally cylindrical relation within the housing 12. Such means is in the form of a thread or string 36 alternately threaded back and forth between the outer periphery of a pair of contact plates 26 to form a cylindrical spider or cage 29.

In this regard, the contact plates 26 are supported in a spaced relation on an insulating support rod 18 by means of a pair of back up washers or plates 28 mounted in a parallel spaced relation on the rod 18. The rod 18 is provided with a threaded section 21 and a pair of flat sections or recesses 23 at each end. The flat sections 23 terminate at a shoulder or step 25.

Each of the contact plates 26 is provided with a series of notches 30 on the outer perimeter of the plate and a central opening 37 having straight sides corresponding to the flats 23 on each end of the rod 18. The contact plates 26 are electrically connected to the end caps by means of tabs 32. Hook tabs 34 and contact members 42 are provided on each of the contact plates 26.

The back up washers 28 are provided with central openings corresponding to the cross section of the support rods at the flats 23.

The thread 36 is formed from a very high temperature inorganic asbestos which does not carbonize at the fusing temperature of the element 22. The thread 36 forms a plurality of small support surfaces arranged in a generally cylindrical relation to provide a support cage or spider for the fuse element 22.

The fuse assembly 15 is assembled by mounting the back up washers 28 on each end of the support rod 18 so that they are seated on the shoulders 25. The contact plates 26 are aligned with the flats 23 at each end of the rod 18 and are moved into abutting engagement with the support plates 28. The flats 23 prevent rotation of the plates 26 relative to the rod 18. The thread or string 36 is threaded back and forth through the slots 30 in the plates 26 to form a support for the fuse element 22. The ends of the string 36 are hooked or looped around the tabs 34 on the contact plate 26.

The fusible element or ribbon 22 is spirally wound around the outer periphery of the support formed by the thread 36. Each end of the element 22 is soldered to one of the members 42 provided on each of the contact plates 26. More than one fusible element 22 can be wound on the threads 36 as desired. The KV rating of the fuse can be varied by changing the distance between the plates 26.

In the event that the thread 36 is not strong enough to support the fuse element 22, one or more dielectric support discs 46 can be provided on the rod 18 intermediate the plates 26.

The fuse assembly 15 is assembled in the housing 12 by screwing one of the end caps onto one end of the rod 18. The assembly 15 is then inserted into the housing 12, sealant applied to the flange 17 on the end cap and then seated in the end of the housing. The housing 12 is fitted with the granular material 27 and the other end cap screwed onto the other end of the rod 18. Sealant is applied to the flange 17 and the end cap is turned into tight engagement with the housing 12. The support rod 18, besides providing tensile strength for the fuse, holds the end caps in position while the sealant cures.

The embodiments of the invention in which an exclusive property or privilege is claimed are defined as follows:

1. A fuse comprising a hollow insulating housing, an electrically conductive end cap on each end of said housing, a fuse assembly supported within the housing by said end caps, said fuse assembly including a fuse element and thread means supporting said fuse element in a substantially cylindrical relation within said housing, and arc quenching means filling said housing.

2. The fuse according to claim 1 wherein said supporting means includes a pair of electrically conductive discs and said thread means being wrapped alternately back and forth around the outer peripheral surface of said discs.

3. The fuse according to claim 2 wherein said fuse element is spirally wrapped around the outer surface of said thread means.

4. The fuse according to claim 2 wherein each of said discs includes means electrically connecting said discs to said end caps and a plurality of notches in the outer periphery of said discs for the thread means.

5. The fuse according to claim 2 wherein said thread means is formed of inorganic material.

6. A fuse assembly for a fuse having an insulating housing and a pair of electrically conductive end caps, said fuse assembly including a support rod, a pair of electrically conductive discs mounted on said support rod in a spaced relation, means for electrically connecting said discs to said end caps, thread means connected to the peripheral portions of each of said discs to form a cylindrical fuse element support, and a fuse element spirally wrapped around said thread means and connected at each end to one of said discs.

7. The assembly according to claim 6 wherein said thread means comprises a single thread.

8. The assembly according to claim 6 wherein said thread means is formed of a dielectric material.

9. The assembly according to claim 7 wherein said thread is formed of inorganic material.

10. A high voltage fuse comprising:

an electrically insulating housing, a pair of electrically conductive end caps at opposite ends of said housing, a fuse assembly supported within said housing by said end caps, said assembly including a supporting thread means and a fuse element supported in said housing by said thread means, and granular filler means in said housing.

11. The fuse according to claim 10 wherein said fuse assembly includes an insulating support rod, a pair of conductive discs supported in a spaced relation on said support rod and including means for connecting said discs to said end caps, said thread means being supported on the outer periphery of said discs and said fuse element being spirally wrapped around said thread means and connected to said discs.

12. The fuse according to claim 10 wherein said threaded means comprises a single thread of inorganic material.

13. The fuse according to claim 10 wherein said end caps each include a threaded bore and said fuse assembly includes a dielectric support rod having a threaded section at each end corresponding to said threaded bore, whereby said end caps are retained on said housing by the threaded engagement of said end caps with said rod.

14. The fuse according to claim 10 wherein said end caps are sealed in said housing.

* * * * *